United States Patent [19]

Honda et al.

[11] 4,297,026

[45] Oct. 27, 1981

[54] CLEANING APPARATUS FOR COPY MACHINES

[75] Inventors: Hiroyuki Honda; Hiroaki Ura, both of Hachioji, Japan

[73] Assignee: Konishiroku Photo Industry Co., Ltd., Tokyo, Japan

[21] Appl. No.: 106,157

[22] Filed: Dec. 21, 1979

[30] Foreign Application Priority Data

Dec. 27, 1978 [JP] Japan ..... 53-160001

[51] Int. Cl.[3] ..... G03G 21/10

[52] U.S. Cl. ..... 355/15; 15/256.51

[58] Field of Search ..... 355/15; 15/256.5, 256.51; 118/652

[56] References Cited

U.S. PATENT DOCUMENTS 3,977,898 8/1976 Hwa ..... 15/256.51 X 4,218,132 8/1980 Iwai et al. ..... 355/15

*Primary Examiner*—Richard L. Moses

*Attorney, Agent, or Firm*—Bierman & Bierman

[57] ABSTRACT

The present invention concerns a thin plate disposed in contact with the surface of a photosensitive drum of a copying machine for guiding toner scraped from the drum surface into a recovery area of the machine; more particularly, it provides for automatic disengagement of the thin plate from its normal contact with the drum surface whenever the drum is not fully engaged within the machine, as during removal and subsequent return for jam clearing or maintenance operations, so as to prevent inadvertent damage to the drum or to the thin plate in the course thereof.

2 Claims, 2 Drawing Figures

CLEANING APPARATUS FOR COPY MACHINES

BACKGROUND OF THE INVENTION

1. Field of the Invention

This invention relates to an apparatus for cleaning an electrophotographic copying or like machine and particularly to a cleaning apparatus having a thin plate capable of guiding toner scraped from a photosensitive element-supporting drum by a cleaning blade.

2. Description of the Prior Art

In an apparatus for cleaning a drum surface of an electrophotographic copying or like machine by using a blade cleaning method, it is known to recover toner scraped from the circumferential surface of a photosensitive or photoconductive drum in a storage portion of the apparatus. Generally, a thin plate is applied to the circumferential surface of the drum so that the toner scraped therefrom may be guided for recovery by the presence of the thin plate.

In an electrophotographic copying or like machine, the photosensitive drum must often be detached from the apparatus, when either a transfer sheet becomes jammed between portions of the apparatus during a copying operation or for performing maintenance on or supervising operation of the machine, as is well known. In that case, it has heretofore been the usual practice to detach and subsequently reattach the drum from and to the machine after first drawing the aforesaid thin cleaning plate away from the drum surface by means of one's fingertip or the like. However, this method or construction is disadvantageous in that the circumferential surface of the drum may be easily damaged by the thin plate or the thin plate damaged by the drum surface through inadvertent carelessness in effecting the removal or return of the drum.

SUMMARY OF THE INVENTION

In order to avoid accidental damage of the thin plate caused by careless handling, the present invention proposes a cleaning apparatus for a copying or like machine having a thin plate applied elastically to the surface of a photosensitive drum and capable of guiding toner scraped from the drum surface through gravity-induced descent. A member responsive to a drum attachment or detachment operation is provided whereby the thin plate may be operatively drawn apart from the drum surface by the functioning of the member.

The present invention is described below in detail with reference to an embodiment thereof shown in accompanying FIGS. 1 and 2.

DETAILED DESCRIPTION OF THE PREFERRED EMBODIMENT

Figure 1:
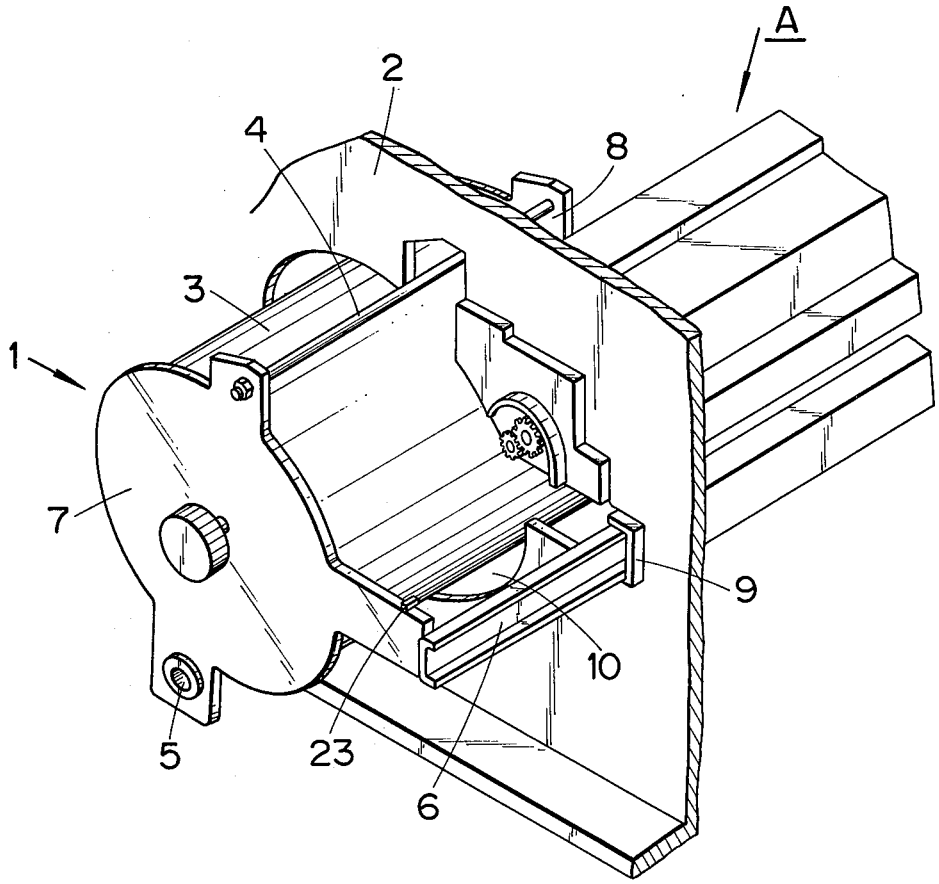
FIG. 1 is an elevated perspective view of a cleaning apparatus for a copying machine in accordance with the present invention.

The example illustrated shows a major portion of an electrophotographic copying machine as being provided with a photosensitive drum 3 set in a supporting member 1 so as to be attachable and detachable, together with supporting member 1, to or from a body frame 2. The supporting member 1 is equipped with a pair of end plates 7, 8 spaced from each other by a spacing bar 4, and further with a rod 5 and a substantially U-shaped frame 6. The photosensitive drum 3 is mounted between front end plate 7 and rear end plate 8, while supporting member 1 is attached to body frame 2 through an attaching opening 10 formed in body frame 2 and a rail 9 that guides U-shaped frame 6.

Figure 2:
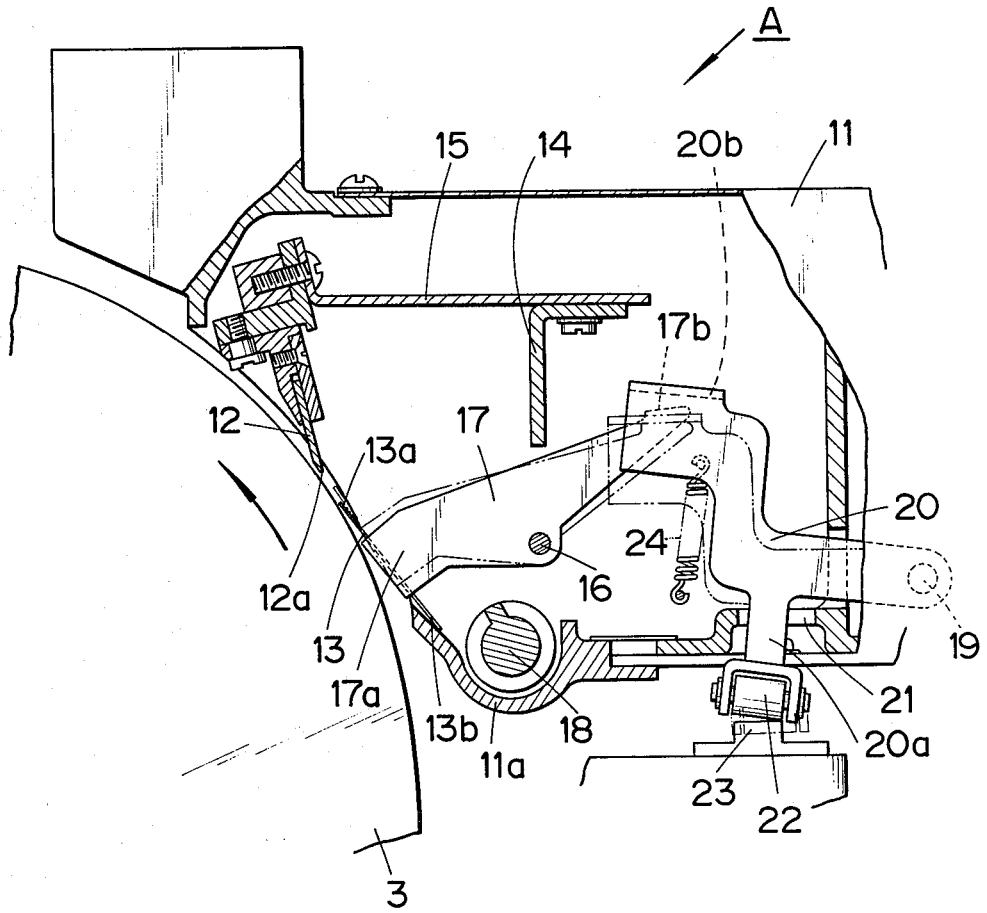
FIG. 2 is an enlarged cross-sectional view of the cleaning apparatus of the invention.

Cleaning apparatus A according to the present invention is positioned in face-to-face relation with the circumferential surface of photosensitive drum 3 and is set in body frame 2 as shown in FIG. 1. Referring now to FIG. 2, the cleaning apparatus is equipped with recovery or storage box 11 having an opening located in face-to-face relation with a portion of the circumferential surface of photosensitive drum 3. Within recovery box 11 are provided a cleaning blade 12 and a thin plate 13 formed of an elastic material such as polyester film or the like, the thin plate being disposed for guiding—in downward, falling travel—toner scraped from the surface of drum 3 by cleaning blade 12. Blade 12 is fixed at its base portion to the tip of an arm 15 secured to a frame 14 within recovery box 11, the tip edge **12*a* of the cleaning blade being operatively positioned in contact with the circumferential surface of drum 3. Thin plate 13 is fixed at an intermediate or middle portion thereof to one end 17*a* of a rotatable or movable holding member 17 supported axially by a pivot 16; one end (the front edge) 13*a* of the thin plate is normally elastically applied to the circumferential surface of photosensitive drum 3. Holding member 17 is in fact provided at both the front and rear sides, both portions thereof being unitarily formed and connected by a connecting member (not shown). Furthermore, the other or opposite end 13*b* of thin plate 13 is placed on a bottom wall 11*a* of recovery box 11. As a consequence, toner scraped from the surface of drum 3 by cleaning blade 12 travels or falls along thin plate 13 to bottom recovery wall 11*a* and is then discharged therefrom by a screw conveyer 18 set in the bottom portion of recovery box 11**.

A driven lever 20 axially supported at one end about an axis 19 is also positioned in recovery box 11. Arm **20*a* of driven lever 20 extends outwardly of recovery box 11 through a window or slit 21 therein. A driven or follower roller 22 provided at the tip of arm 20*a* is in operative contact with an action piece 23 mounted on front end plate 7. Driven lever 20 is normally urged by a biasing member or spring 24 for movement in the counterclockwise direction (FIG. 2) and further includes an operating piece 20*b* projecting at substantially a right angle at the top end thereof; operating piece 20*b* is disposed in face-to-face relation with an end portion 17*b* of holding member 17**.

Action piece 23 serves to rotate driven lever 20 in the clockwise direction (FIG. 2) through driven roller 22 so that end **13*a* of thin plate 13 is moved into contact with the surface of drum 3** when the drum is installed at its predetermined position in the machine.

When drum 3 is fully mounted or installed at its predetermined position in the copying machine, driven roller 22 is pushed upward by action piece 23 to the solid line position seen in FIG. 2, whereby driven lever 20 is rotated in the clockwise direction against the urgency of spring 24. As a consequence, operating piece **20*b* of driven lever 20 is carried away from holding member 17 and tip end 13*a* of thin plate 13 is brought elastically into contact with the circumferential surface of drum 3**.

When supporting member 1 or drum 3 is slightly withdrawn from the body frame 2, on the other hand, action piece 23 is moved away from driven roller 22 and driven lever 20 is rotated counter-clockwise by the force or urgency of spring 24 to the imaginary or dotted line position shown in FIG. 2. As a result, end **17*b* of holding member 17 is forced downward by operating piece 20*b* and thereby shifted to the dotted line position shown in FIG. 2 whereby the tip 13*a* of thin plate 13 is withdrawn from the surface of drum 3. This withdrawn state of thin plate 13 is maintained until the drum is fully mounted or seated on body frame 2, and thus the possibility of damage to the thin plate 13** resulting from carelessness in the drum removal or return operations is virtually eliminated.

As is clear from the foregoing explanation, the present invention provides positive avoidance of damage to the thin plate and to the drum caused by carelessness since withdrawal and contact of the thin plate with respect to the drum surface is carried out automatically in response to attachment and detachment of the drum.

What we claim is:

1. In a cleaning apparatus for a copying machine including a photosensitive drum detachably mounted on the machine frame, cleaning means for scraping toner from the drum surface, and a thin plate normally applied to the drum surface for guiding toner scraped therefrom by the cleaning means into a toner recovery box, the improvement comprising:

a pivotally mounted member normally supporting the thin plate in engagement with the drum surface;

a lever operatively engagable with said pivotally mounted member;

biasing means urging said lever into engagement with said pivotally mounted member to rotate the same to move the thin plate to a position withdrawn from the drum surface; and an action piece associated with the photosensitive drum and disposed for engagement with said lever when the drum is mounted on the machine frame to cause said lever to become disengaged from said member against the action of said biasing means so that the member normally supports the thin plate in contact with the drum surface;

whereby detachment of the drum from the machine frame causes said action piece to disengage said lever which there upon moves into engagement with said member under the action of said biasing means to move the thin plate to a position withdrawn from the drum surface and thereby prevent damage to the thin plate or to the drum surface as the drum is detached from or reattached to the machine frame.

2. In a cleaning apparatus for a copying machine according to claim 1 and in which the machine further includes a pair of end plates between which the photosensitive drum is mounted, said improvement further comprising:

an arm on said lever;

a roller mounted on said arm and forming the engagement between said lever and said action piece; and means supporting said action piece on one of said end plates.

* * * * *